US007140225B2

(12) United States Patent
Takahashi et al.

(10) Patent No.: US 7,140,225 B2
(45) Date of Patent: Nov. 28, 2006

(54) METHOD OF BENDING PIPE AND APPARATUS THEREFOR

(75) Inventors: Hiroyuki Takahashi, Shizuoka-ken (JP); Hiroshi Takada, Shizuoka-ken (JP)

(73) Assignee: Yutaka Giken Co., Ltd., Shizuoka-Pref (JP)

( * ) Notice: Subject to any disclaimer, the term of this patent is extended or adjusted under 35 U.S.C. 154(b) by 0 days.

(21) Appl. No.: 11/016,451

(22) Filed: Dec. 17, 2004

(65) Prior Publication Data

US 2005/0172692 A1 Aug. 11, 2005

(30) Foreign Application Priority Data

Feb. 9, 2004 (JP) ..... 2004-031718

(51) Int. Cl.
*B21D 9/08* (2006.01)

(52) U.S. Cl. ..... 72/369; 72/389.8

(58) Field of Classification Search ..... 72/297, 72/369, 383, 389.8, 398, 466.2; 29/890.149
See application file for complete search history.

(56) References Cited

U.S. PATENT DOCUMENTS 2,516,372 A * 7/1950 Cross ..... 72/364
3,359,776 A * 12/1967 Faull ..... 72/389.8

FOREIGN PATENT DOCUMENTS

| | | |
|---|---|---|
| JP | 02-030328 | 1/1990 |
| JP | 06-047450 | 2/1994 |
| JP | 11-285737 | 10/1999 |

* cited by examiner

*Primary Examiner*—Lowell A. Larson
(74) *Attorney, Agent, or Firm*—Bachman & LaPointe, P.C.

(57) ABSTRACT

A movable die base (2) is moved toward a stationary die base (1). A pressing force is applied by a bending punch (21) disposed on the movable die base to a bending target portion of a pipe (A) which is placed on a die (11) provided on the stationary die base and which has inserted therein a core metal (17). At the time of this bending work, both ends of the pipe are restricted by holding them with restriction pads (22). When the pressing force is applied by the bending punch, the restriction pads are displaced to follow the pressing of the bending punch, whereby restricted state on both ends of the pipe is constantly maintained.

8 Claims, 5 Drawing Sheets

METHOD OF BENDING PIPE AND APPARATUS THEREFOR

BACKGROUND OF THE INVENTION

1. Field of the Invention

This invention relates to a method of bending a pipe and an apparatus therefor and relates, in particular, to a method of, and apparatus for, smoothly bending a thin-wall metallic pipe such as a tail pipe for use in an automobile.

2. Description of the Related Art

When this kind of metallic pipe is subjected to bending work, wrinkling or deformation is likely to occur to the bent pipe if the restriction force on both ends of the pipe is not sufficient.

As a solution, there is known the following art. Namely, when a movable die base is moved toward a stationary die base in bending a pipe, one side of the pipe is fixed by pinching or holding by a pair of holding chucks which are disposed on both the die bases. The other side of the pipe is held by a pair of bending punches which are disposed on respective die bases in a manner to be swingable about that supporting shaft serving as a center of swinging movement which is disposed in a manner deviated in position in the axial direction of the pipe. These pair of bending punches are swung to thereby perform bending work.

In the above-described arrangement, at the time of bending, one end of the pipe is fixed and the other end of the pipe is subjected to bending work by applying a force from the outside toward the inside of the pipe, both as seen in the bending direction. Consequently, a large compression force is operated on the portion lying on the inside as seen in the bending direction, resulting in the occurrence of wrinkling or deformation as well as in a consequent failure in obtaining a stable bending accuracy. In case a pipe made by welding is subjected to bending work with the welded seam lying on the inside as seen in the bending direction, a large compression force may cause damages to the welded seam.

SUMMARY OF THE INVENTION

In view of the above-described disadvantages of the conventional art, this invention has an object of providing a method of bending a pipe as well as an apparatus therefor in which the wrinkling or deformation can be prevented, thereby attaining a stable bending accuracy.

According to one aspect of this invention, there is provided a method of bending a pipe comprising the steps of: setting a pipe in a manner capable of giving in under a pressing force; inserting into the pipe a core metal having a forming section along which the pipe is to be bent, said core metal being positioned at a bending target portion of the pipe; applying a restricting force to both ends of the pipe as seen in a longitudinal direction of the pipe; and applying the pressing force to the bending target portion of the pipe in a state of restricting the pipe such that a point of operating the restricting force displaces depending on a progress of applying the pressing force, whereby the pipe remains constantly restricted while the pressing force is being applied.

According to another aspect of this invention, there is provided a method of bending a pipe comprising: moving at least one of a pair of die bases lying opposite to each other toward the other thereof; applying a pressing force to a bending target portion of a pipe by a bending punch disposed on one of the die bases, the pipe being placed on a die provided on the other of the die bases and having inserted therein a core metal so as to be bent along a forming section of the core metal; and holding both ends of the pipe by restricting means such that, when the pressing force is applied to the bending target portion by the bending punch, the restricting means is displaced to follow the pressing by the bending punch, whereby the pipe is bent in a state in which the restriction at both ends of the pipe is maintained.

According to this arrangement, the pressing force is applied by the bending punch to the pipe on the inside thereof as seen in the bending direction of the pipe which is supported by the die on the outside thereof as seen in the bending direction. The pipe is thus bent along the forming section of the core metal in a state in which both ends of the pipe are kept restricted by the restricting means. Therefore, when the pipe is subjected to the bending work, a large compression force is not applied to the inside of the pipe as seen in the bending direction thereof. As a result, the pipe can be prevented from being wrinkled or deformed, thereby attaining a stable bending accuracy.

Preferably, the pipe is formed of predetermined shape of sheet metal into a cylindrical shape with both longitudinal free ends thereof welded together.

According to this arrangement, even in case where the pipe is bent with a welded seam lying on the inside as seen in the bending direction, the welded seam can be prevented from being damaged by a large compression force.

According to another aspect of this invention, there is provided an apparatus for bending a pipe comprising: a pair of die bases lying opposite to each other; a bending punch for applying a pressing force to a bending target portion of a pipe, the bending punch being disposed on one of the die bases; a die for placing thereon the pipe, the die being disposed on the other of the die bases such that at least one of the die bases is moved toward the other thereof to apply the pressing force by the bending punch to bend the pipe along a forming section of a core metal inserted into the pipe; and restriction means for restricting the pipe by holding both longitudinal ends thereof, the restriction means being arranged to be displaceable to follow a movement of the bending punch in a pressing direction.

Preferably, the restriction means is a restriction pad disposed on said one of the die bases. The die is made up of two segments, each of the segments being arranged to be swingable, under the pressing force by the bending punch, about a supporting shaft provided respectively toward each longitudinal end of the pipe. The restriction pad displaces to follow the swinging of each of the segments of the die.

Further, in order to facilitate the mounting and dismounting of the pipe, the core metal is preferably disposed on the die in a manner to be swingable about a supporting shaft at one end of the core metal.

As described above, according to this invention, there can be obtained an advantage in that the pipe is prevented from giving rise to wrinkling, deformation, and the like, whereby a stable bending accuracy can be attained.

BRIEF DESCRIPTION OF THE DRAWINGS

The above and other objects and the attendant features of this invention will become readily apparent by reference to the following detailed description when considered in conjunction with the accompanying drawings wherein:

FIG. 3 is a side view, partly shown in section, of the bending apparatus according to this invention in a state in which the pipe is restricted at both ends with a bending target portion lying in between;

DETAILED DESCRIPTION OF THE PREFERRED EMBODIMENTS

Figure 1A:
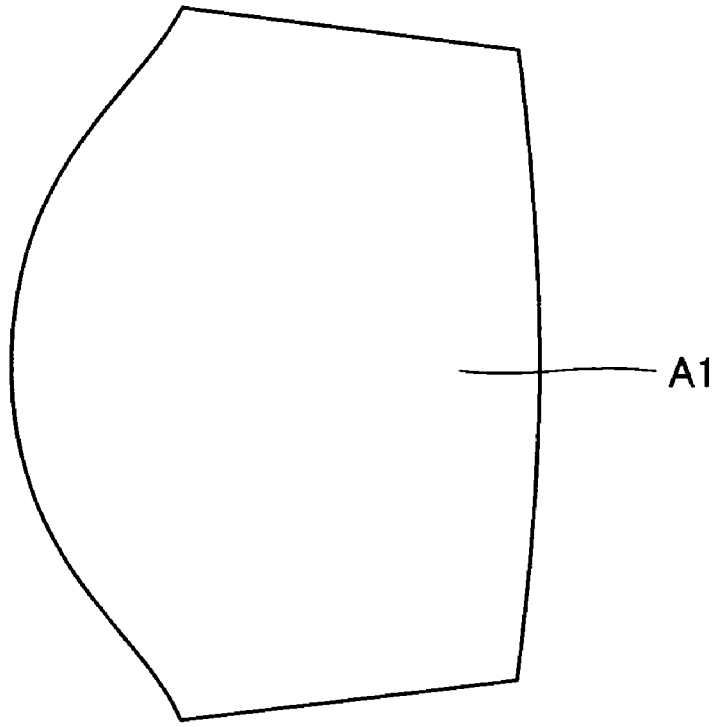
FIGS. 1A through 1C are views to explain the method of bending a pipe according to this invention as well as a tail pipe which is subjected to bending by an apparatus for bending a pipe (hereinafter also referred to as a bending apparatus) according to this invention.

A description will now be made about a preferred embodiment of this invention with reference to the accompanying drawings. With reference to FIGS. 1B and 1C, reference character "A" denotes a thin-wall metallic pipe which is to be subjected to the bending work by using the method of bending a pipe and the apparatus therefor according to this invention. This pipe is, e.g., a tail pipe which is disposed on the most downstream side of the exhaust system of an automobile. It is formed as follows.

Figure 1B:
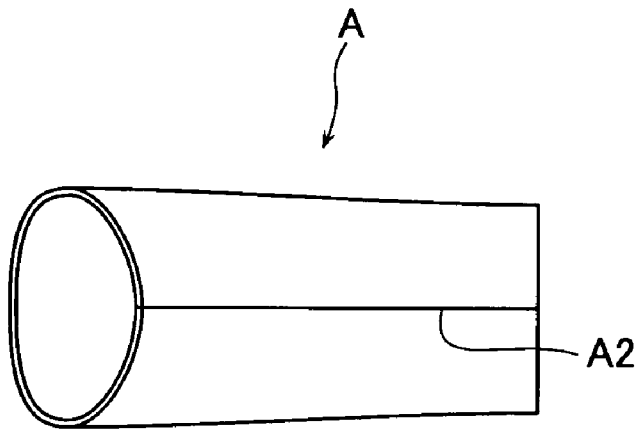
Figure 1C:
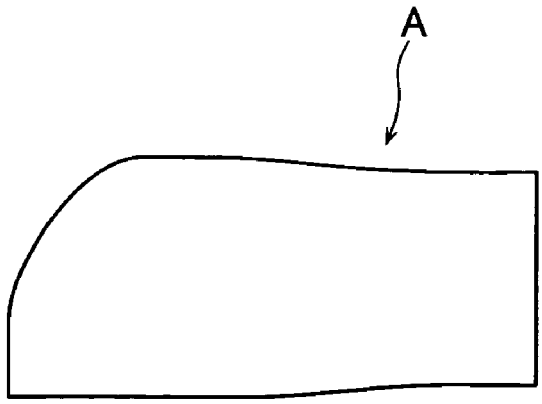

A metallic material of stainless steel having a thickness of 1 mm is subjected to die cutting into a sheet material A1 of a predetermined shape (see FIG. 1A). It is then formed into a cylindrical shape and the free ends thereof as seen in the longitudinal direction of the pipe are welded together (FIG. 1B). An opening at one end of this tail pipe "A" is formed at an inclination (FIG. 1C).

FIGS. 2 through 5 show an apparatus B for bending the tail pipe "A" manufactured as described above at a given curvature with the welded seam A2 lying on the inside as seen in the direction of bending. The bending apparatus B is made up of: a stationary die base 1; and a movable die base 2 which is movable in a vertical direction toward and away from the stationary die base 1 by a driving means (not illustrated) and which is provided with a bending punch 21 for applying a pressing force to a bending target portion of the tail pipe "A". The stationary die base 1 is provided with a die 11 on which the tail pipe "A" is placed in position.

The die 11 is made up of two segments 11*a*, 11*b*. Each of the segments 11*a*, 11*b* is mounted in a manner to be swingable about a supporting shaft (pin) 12 mounted on the stationary die base 1 at positions on both sides along the longitudinal direction of the tail pipe "A" to be placed on the die 11. Each of the segments 11*a*, 11*b* has formed therein a semicircular recessed groove 111 (see FIG. 4) into which the longitudinal lower half of the tail pipe "A" is to be fitted.

On a lower side of each of the segments 11*a*, 11*b* of the die 11, there is disposed a cushion plate 13 which supports each of the segments 11*a*, 11*b*. On the lower side of the cushion plate 13, there is disposed an urging means (or forcing means) 14 such as an urethane spring which applies an urging force (or pushing force) in an upward direction (i.e., in a direction opposite to the pressing direction of the bending punch; to be described in detail hereinafter). The urging force of the urging means 14 is set in the following manner. Namely, in a state free from the pressing force by the bending punch 21, each of the segments 11*a*, 11*b* of the die 11 is kept horizontal by the cushion plate 13. Once the pressing force is applied by the bending punch 21, each of the segments 11*a*, 11*b* of the die 11 is swung downward with each of the pins 12 serving as the center of swinging movement so as to follow the downward movement (i.e., in the pressing direction) of the bending punch 21. There is provided a stopper bolt 15 to prevent the cushion plate 13 from getting out of position or from deviating when the pressing force of the bending punch 21 is released upon completion of the bending work.

One segment 11*b* of the die 11 is provided with a core-metal holder 16. A core metal 17 is attached to this core-metal holder 16 in a manner to be swingable about a pin (supporting shaft) 17*a*. At that front (free) end of the core metal 17 which lies opposite to the pin 17*a*, a forming section 17*b* to set the curvature at the time of bending is formed or configured in manner to bridge the recessed groove 111 in each of the segments 11*a*, 11*b*. It is thus so arranged that the tail pipe "A" is subjected to bending processing at substantially the central portion thereof.

An urging (or forcing) means 17*c* to apply an upward urging (or pushing) force is disposed on the lower side of the core metal 17. In a state free from the pressing force of the bending punch 21, the core metal 17 is kept to an erected state by the urging force of the urging means 17*c*. When the core metal 17 is subjected to the pressing force of the bending punch 21, the core metal 17 is swung downward against the urging force of the urging means 17*c*, so that the lower half of the tail pipe "A" is caused to fit into the recessed groove 111 of the die 11.

It is so arranged that, when the tail pipe "A" is placed on the bending apparatus, the tail pipe "A" is held in position (or aligned) by bringing one end of the tail pipe "A" into abutment with the core-metal holder 16. At the other end of the tail pipe "A," there is disposed a substantially cylindrical deformation-prevention core metal 18 in a manner to be inserted into the tail pipe "A" in order to prevent the tail pipe "A" from being deformed by the pressing force of restriction pads (to be described hereinafter). An urging means 18*a* such as a spring is provided on the other segment 11*a* of the die 11 to prevent the deformation-prevention core metal 18 from being stricken out of position in the course of the bending work. The core metal 17 and the deformation-prevention core metal 18 may be made of a material having a strength larger than that of the tail pipe "A" which is subjected to the bending work.

On the lower surface of the bending punch 21 which applies the pressing force to the bending target portion of the tail pipe "A," there is formed a semicircular recessed groove 211 into which is fit the longitudinally extending upper half of the tail pipe "A." The recessed groove 211 is curved at the same curvature as that of the forming section 17*b*. The restriction pads 22*a*, 22*b* serving as the restriction means for restricting the tail pipe "A" by holding both ends thereof are disposed on longitudinal both ends of the tail pipe "A."

A semicircular recessed groove 221 (FIG. 4) into which is fit the longitudinally extending upper half of the tail pipe "A" is also respectively formed in the lower surface of the restriction pads 22*a*, 22*b*. The restriction pads 22*a*, 22*b* are fixed to holders 24 which are respectively disposed on the movable die base 2 through a gas-operated cushion 23. The restriction pads 22*a*, 22*b* respectively have formed arcuate slots 222*a*, 222*b* in an upper part thereof. The restriction pads 22*a*, 22*b* are attached to the holders 24 by inserting into the slots 222*a*, 222*b* a pin 241 provided in a projecting manner in each of the holders 24.

The slots 222*a*, 222*b* have the following construction. Namely, in a state in which the bending punch 21 is away from the tail pipe "A," each of the restriction pads 22*a*, 22*b* is held in a horizontal posture by its own weight. When the movable die base 2 is moved toward the stationary die base 1, the lower surface 223 of the restriction pad 22*a*, 22*b* so far held in a horizontal posture comes into pressing contact with the upper surface 112 of the respective segments 11*a*, 11*b* of the die 11, thereby operating the restricting force on both ends of the pipe "A" through a contact point between the restriction pad 22*a*, 22*b* and the holder 24, restricting both ends of the tail pipe "A." When the tail pipe "A" is bent under the pressing force of the bending punch 21, the restriction pads 22*a*, 22*b* are allowed to be displaced to follow the swinging movement of each of the segments 11*a*, 11*b* of the die 11, thereby maintaining the above-described pressed state.

The upper surface 224*a*, 224*b* of the restriction pad 22*a*, 22*b* is respectively formed into an arc which is substantially concentric with the slot 222*a*, 222*b*. The upper surface 224*a*, 224*b* is in abutment with the horizontal surface 242 formed in the holder 24. When the segment 11*a*, 11*b* of the die 11 is swung, the restriction pad 22*a*, 22*b* is allowed to slide along the horizontal surface 242 and is displaced accordingly (i.e., the contact point of operating the respecting force is displaced accordingly). As a result, during the time when the restriction pad 22*a*, 22*b* is displaced, the pressing force to press the lower surface 223 of the restriction pad 22*a*, 22*b* against the upper surface 112 of the segment 11*a*, 11*b* remains constantly operated.

If the restriction pad 22*a*, 22*b* gets out of position relative to the tail pipe "A" held in position (alignment) on the die 11, during the bending work to be performed by moving the movable die base 2, the quality of the products thus manufactured may vary from products to products. As a solution, a vertical hole 225 whose lower end is open to access is formed in the restriction pad 22*a*, 22*b*, and an upwardly projecting positioning pin 19 is provided in the segment 11*a*, 11*b* so as to lie opposite to the vertical hole 225. It is thus so arranged that, when the movable die base 2 is moved toward the stationary die base 1, the positioning pin 19 gets engaged with the vertical hole 225, thereby positioning the restriction pad 22*a*, 22*b* relative to the tail pipe "A."

Figure 2:
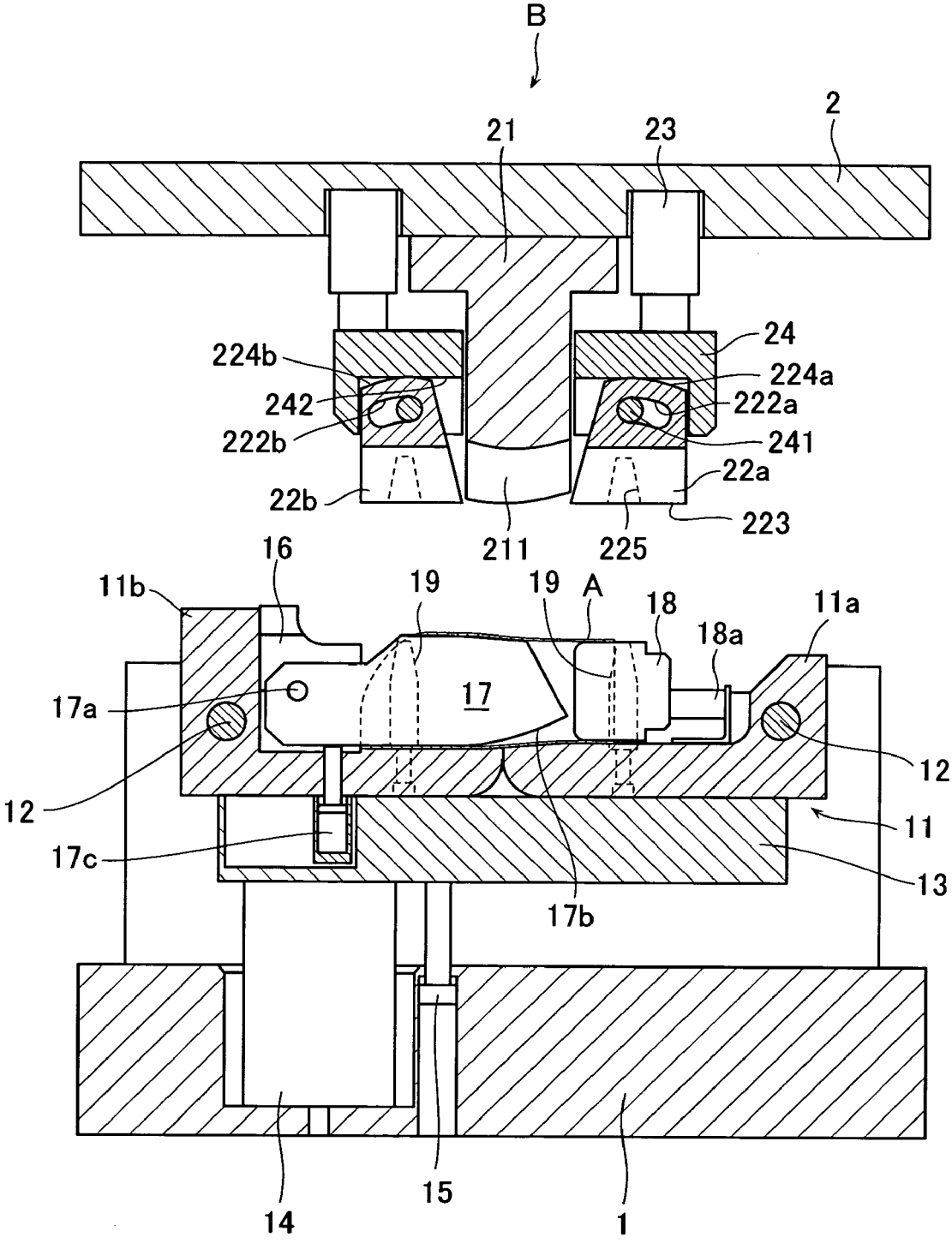
FIG. 2 is a side view, partly shown in section, of the bending apparatus according to this invention in a standby state.

A description will now be made about the bending operation of the tail pipe "A" by using the above-described bending apparatus B. As shown in FIG. 2, in a standby state in which the movable die base 2 is away from the stationary die base 1, the tail pipe "A" which is subjected to the bending work is placed in position. In placing the tail pipe "A" in position, the core metal 17 is erected by the urging force of the urging means 17*c*. The tail pipe "A" is then put onto the outside of the core metal 17 (i.e., the core metal 17 becomes a state of being inserted into the tail pipe "A") from the inclined free end of the core metal 17 with the welded seam A2 facing upward until the end of the tail pipe "A" comes into abutment with the core-metal holder 16. Thereafter, the deformation-preventing core metal 18 is placed on the other end of the tail pipe "A" and setting is made so that the urging force of this urging means 18*a* is applied to the deformation-preventing core metal 18.

Then, the movable die base 2 is moved downward (i.e., toward the stationary die base 1) by a driving means (not illustrated). The positioning pin 19 respectively gets engaged with the vertical hole 225 in the restriction pad 22*a*, 22*b*, thereby holding the restriction pad 22*a*, 22*b* in position. Subsequently, the upper half in substantially the central portion of the tail pipe "A" is fit into the recessed groove 211 of the bending punch 21. The core metal 17 is swung downward, with the pin 17*a* serving as the center of swinging movement, by the pressing force of the bending punch 21 against the urging force of the urging means 17*c*. The longitudinally extending lower half of the tail pipe "A" is thus fit into the recessed groove 111.

Figure 3:
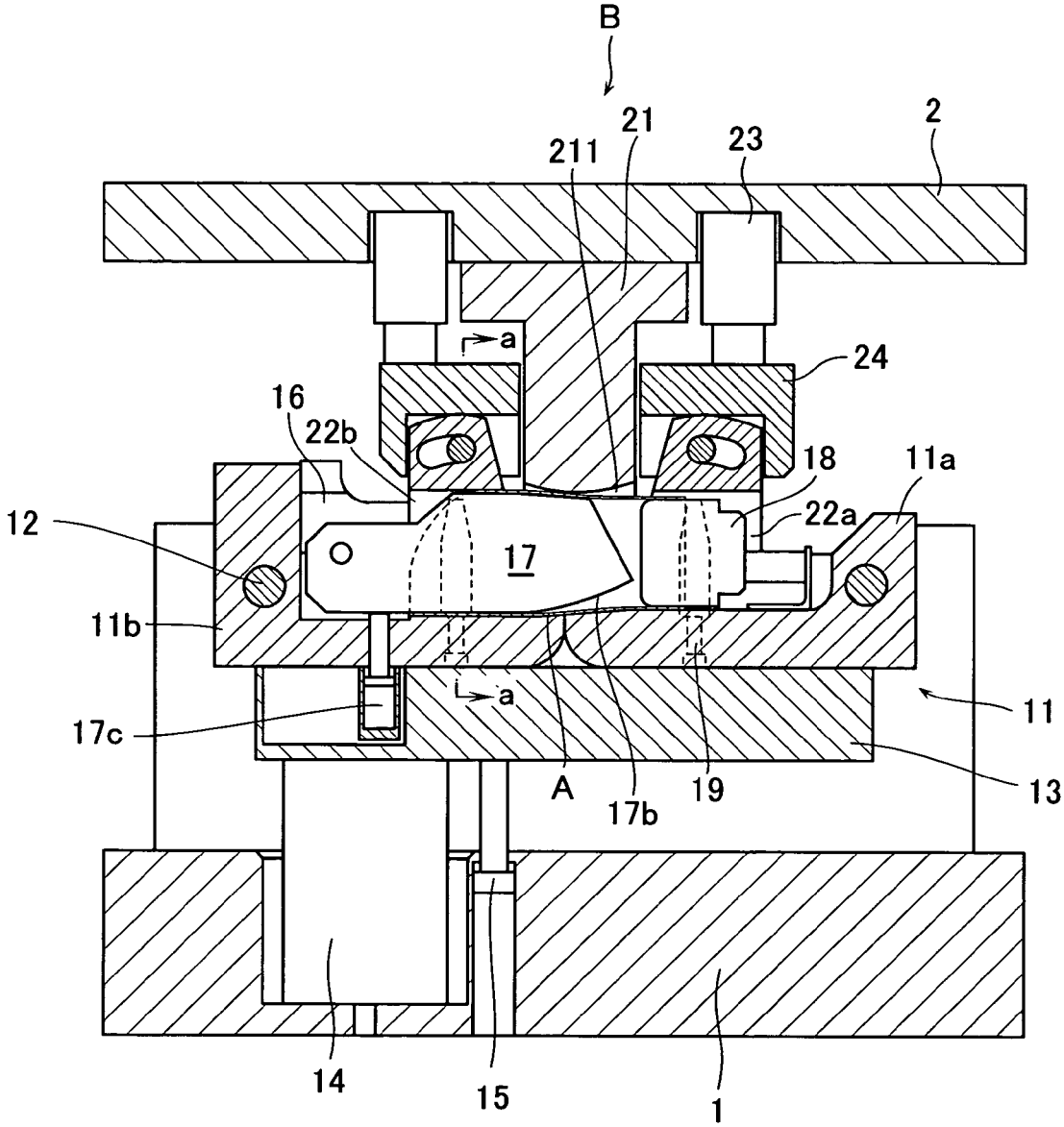
Figure 4:
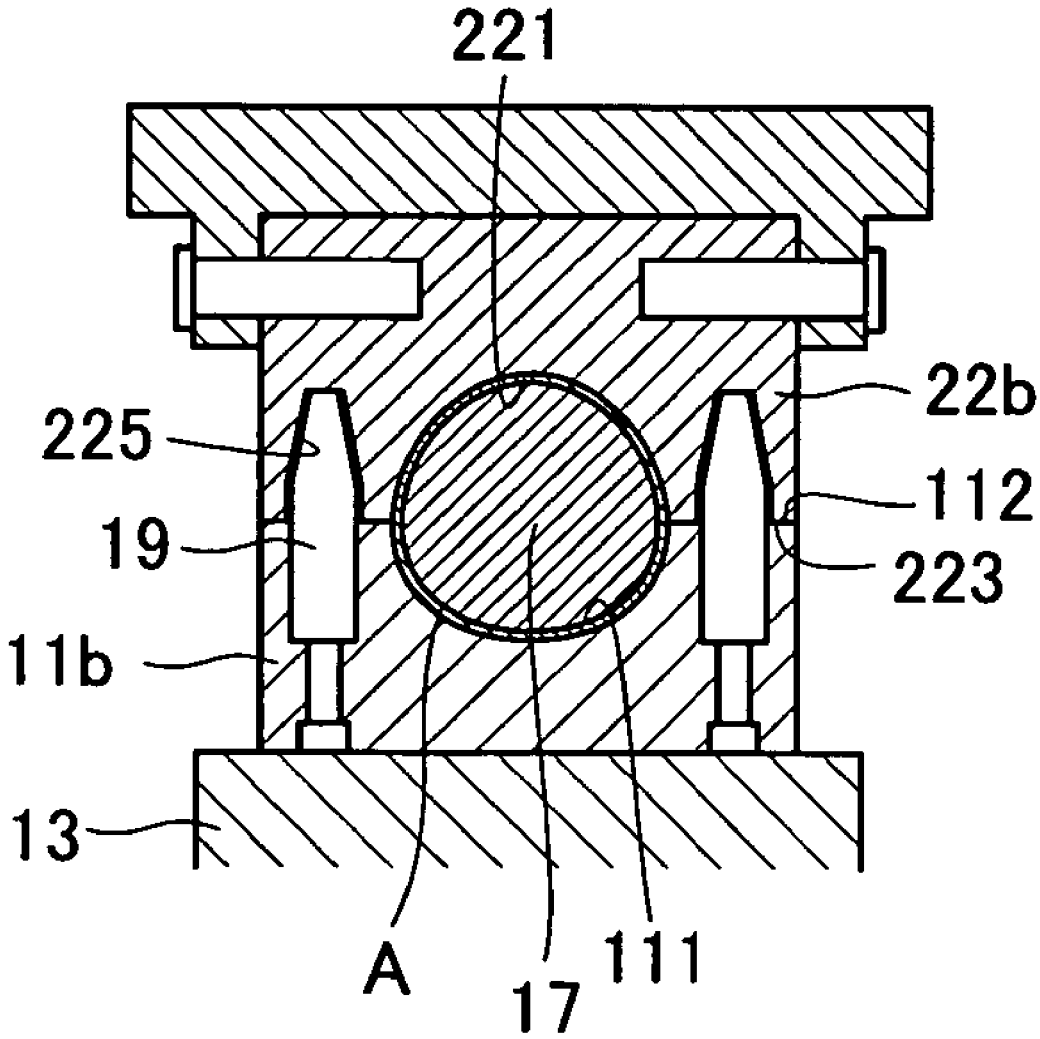
FIG. 4 is a sectional view taken along the line "a–a" in FIG. 3.

Then, the longitudinally extending upper half of the tail pipe "A" is fit at both ends thereof into the recessed groove 221 of the restriction pad 22*a*, 22*b*, and the lower surface 223 of the horizontally held restriction pad 22*a*, 22*b* comes into forced abutment with the upper surface 112 of the respective segments 11*a*, 11*b* of the die 11, thereby restricting both ends of the tail pipe "A." The result is as shown in FIGS. 3 and 4. As an alternative arrangement, the tail pipe "A" may be brought into abutment with the segments 11*a*, 11*b* of the die 11 before the movable die 2 is moved downward.

Figure 5:
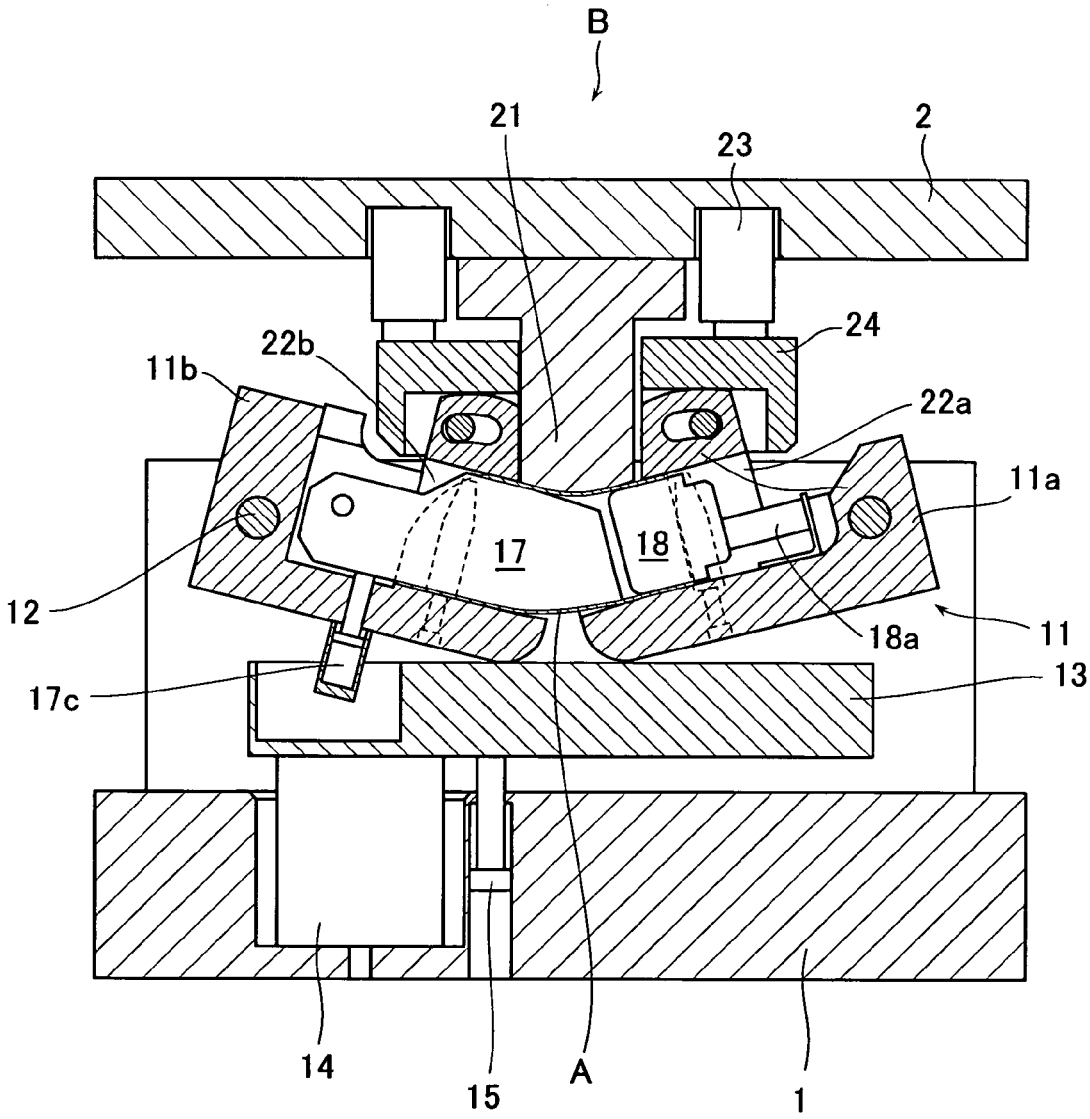
FIG. 5 is a side view, partly shown in section, of the bending apparatus according to this invention in a state in which the bending of the pipe is finished.

Subsequently, the movable die base 2 is moved downward to thereby apply the predetermined pressing force, which is set in advance, by the bending punch 21 to the tail pipe "A," whereby the tail pipe "A" is subjected to bending. Each of the segments 11*a*, 11*b* of the die 11 is swung with the pin 12 serving as the center of swinging movement to follow the pressing force of the bending punch 21. Also, the restriction pad 22*a*, 22*b* is displaced along the respective slots 222*a*, 222*b* to follow the swinging movement of each of the segments 11*a*, 11*b*. As a result, during the bending work, both ends of the tail pipe "A" with the bending target portion lying therebetween remain constantly restricted by being firmly held (or pinched). The tail pipe "A" is thus bent along the forming section 17*b* of the core metal 17, thereby attaining a state as shown in FIG. 5 in which the bending work is finished.

Once the bending work is finished, the movable die base 2 is moved upward to bring it to the standby state as shown in FIG. 2. At this time, the core metal 17 is erected by the urging force of the urging means (spring) 17*c*, and the bent tail pipe "A" is taken out of the bending apparatus B.

In this manner, the pressing force is applied by the bending punch 21 to the inside, as seen in the bending direction, of the tail pipe "A" whose outside, as seen in the bending direction, is supported by the segment 11*a*, 11*b* of the die 11. The tail pipe "A" is thus bent along the forming section 17*b* of the core metal 17 in a state in which both ends of the tail pipe "A" are kept restricted by the restriction pads 22*a*, 22*b*. Therefore, when the tail pipe "A" is subjected to the bending work, a large compression force is not operated on the inside as seen in the bending direction. It is thus possible to prevent the occurrence of deformation and wrinkling, whereby a stable bending accuracy can be obtained, and the welded seam A2 of the tail pipe "A" can be prevented from being damaged.

A description has so far been made about the example of bending the tail pipe "A." It is to be noted that this invention is not limited to the above, but that this invention is applicable to the bending of a thin metallic pipe in general. Needless to say, the curvature is freely variable by changing the shape of the forming section.

What is claimed is:

1. A method of bending a pipe comprising:

moving at least one of a pair of die bases lying opposite to each other toward the other thereof;

applying a pressing force to a bending target portion of a pipe by a bending punch disposed on one of said die bases, said pipe being placed on a die provided on the other of said die bases and having inserted therein a core metal so as to be bent along a forming section of said core metal; and holding both ends of the pipe between a pair of restriction pads provided on the one of said die bases and said die such that, when the pressing force is applied to the bending target portion by said bending punch, said pair of restriction pads and said die are displaced to follow the pressing by said bending punch, whereby the pipe is bent in a state in which the restriction at both ends of the pipe is maintained.

2. The method according to claim 1, wherein the pipe is formed of predetermined shape of sheet metal into a cylindrical shape with both longitudinally extending free ends thereof welded together, and is bent with the welded seam lying on the inside seen in bending direction.

3. An apparatus for bending a pipe comprising:

a pair of die bases lying opposite to each other;

a bending punch for applying a pressing force to a bending target portion of a pipe, said bending punch being disposed on one of said die bases;

a die for placing thereon the pipe, said die being disposed on the other of said die bases such that at least one of said die bases is moved toward the other thereof to apply the pressing force by said bending punch to bend the pipe along a forming section of a core metal inserted into the pipe;

a pair of restriction pads disposed on said one of said die bases;

said die comprises two segments, each of said segments being arranged to be swingable, under the pressing force by said bending punch, about a supporting shaft provided respectively toward each longitudinal end of the pipe; and said pair restriction pads displacing to follow the swinging of each of said segments of said die.

4. The apparatus according to claim 3, wherein said core metal is disposed on said die in a manner to be swingable about a supporting shaft at one end of said core metal.

5. The apparatus according to claim 3, wherein said pair of restriction pads is provided with a arcuate slot in an upper part thereof and is attached to a holder affixed to one of said die base, by inserting into the slots a pin provided in a projecting manner in said holder, an upper surface of said pair of restriction pads is formed into an arc which substantially concentric with said slot and is in abutment with a horizontal surface formed in the holder, and the restriction pad is allowed to slide along said horizontal surface and is displace, when each of said segments of said die is swung.

6. The apparatus according to claim 5, wherein said holder is provided with one of said die base through a cushion.

7. The apparatus according to claim 5, wherein said pair of restriction pads is held in a horizontal posture by its weight in state in which the bending punch is away from said pipe.

8. The apparatus according to claim 5, wherein a vertical hole whose lower end is open to access is formed in said pair of restriction pads, an upwardly projecting positioning pin is provided in each of said segments so as to lie opposite to said vertical hole, and said positioning pin gets engaged with the vertical hole when at least one of said die bases is moved toward the other, thereby positioning the restriction pad relative to said pipe.

* * * * *